US005197594A

United States Patent [19]

Drexler et al.

[11] Patent Number: 5,197,594

[45] Date of Patent: Mar. 30, 1993

[54] ARRANGEMENT FOR COUPLING AN AUXILIARY SWITCH MECHANISM

[75] Inventors: Johann Drexler, Schwandorf; Erwin Flierl, Kuemmersbruck; Werner Harbauer, Schwandorf, all of Fed. Rep. of Germany

[73] Assignee: Siemens Aktiengesellschaft, Berlin and Munich, Fed. Rep. of Germany

[21] Appl. No.: 765,402

[22] Filed: Sep. 24, 1991

Related U.S. Application Data

[63] Continuation of Ser. No. 494,823, Mar. 15, 1990, abandoned, which is a continuation-in-part of Ser. No. 157,075, Feb. 3, 1988, abandoned, which is a continuation of Ser. No. 821,563, Jan. 22, 1986, abandoned.

[30] Foreign Application Priority Data

Jan. 31, 1985 [DE] Fed. Rep. of Germany ..... 3503292

[51] Int. Cl.[5] ..... H01H 3/20

[52] U.S. Cl. ..... 200/318; 200/307; 335/132

[58] Field of Search ..... 200/50 R, 50 A, 50 B, 200/50 C, 51.12, 318, 325, 330, 334, 338, 293, 307; 335/132

[56] References Cited

U.S. PATENT DOCUMENTS

| | | | |
|---|---|---|---|
| 2,672,536 | 3/1954 | Rosing | 200/104 |
| 2,977,438 | 3/1961 | Morschel | 200/87 |
| 3,243,564 | 3/1966 | Burch | 200/295 |
| 3,325,690 | 6/1967 | Kruzic et al. | 335/132 |
| 3,388,353 | 6/1968 | Isler | 335/132 |
| 3,812,440 | 5/1974 | Cook | 335/132 |
| 3,882,435 | 5/1975 | Grass et al. | 335/132 |
| 4,345,225 | 8/1982 | Lemmer | 335/132 |
| 4,559,456 | 12/1985 | Yamamoto et al. | 200/5 B |

FOREIGN PATENT DOCUMENTS 0189924 9/1989 European Pat. Off. .

*Primary Examiner*—Linda J. Sholl
*Attorney, Agent, or Firm*—Adel A. Ahmed

[57] ABSTRACT

The invention concerns an arrangement to couple an auxiliary switch mechanism to an electrical switchgear unit, preferrably a contactor, with a contact slide piece onto which the moving contact pieces are mounted, and a switchgear housing onto which the switchgear fixed-mounted contact pieces are mounted. The contact slide pieces of the switchgear unit and the auxiliary switch mechanism are mounted so that they can slide transversely to the direction of connection. A projection of the auxiliary switch mechanism is positioned in a cutout of the contactor in an interlocking fashion. The connection of contact slide pieces similarly takes place in a positive, interlocking fashion. A lock makes an effective connection with the position of the contact slide piece in the auxiliary switch mechanism, thereby preventing the removal of the auxiliary switch mechanism when the unit is switched on.

41 Claims, 4 Drawing Sheets

ARRANGEMENT FOR COUPLING AN AUXILIARY SWITCH MECHANISM

CROSS-REFERENCE TO RELATED APPLICATION

This is a continuation of Ser. No. 07/494,823 filed Mar. 15, 1990, which is a continuation-in-part of Ser. No. 07/157,075 filed Feb. 3, 1988, which is a continuation of Ser. No. 06/821,563 filed Jan. 22, 1986 all now abandoned.

BACKGROUND OF THE INVENTION

This invention relates to an arrangement to couple an auxiliary switch mechanism to an electrical switchgear unit, perferrably a contactor, with a contact sliding piece holding the movable contact pieces and a housing holding the fixed-mounted contact pieces.

In an arrangement known from U.S. Pat. No. 2,977,438, a housing of an auxiliary switch mechanism is locked in place with the housing of a switchgear unit. The contact slide piece of the auxiliary switch mechanism is brought into operative connection with the contact slide piece of the switchgear unit by a non-positive connection only. Thus, said arrangement does not ensure that both contact slide pieces necessarily assume the same position.

It is further known from U.S. Pat. No. 2,672,536 to provide the contact slide piece and housing with claw-shaped projections which can make contact by sliding sideways against each other. If in this configuration the auxiliary switch mechanism is slipped "ON" while the unit is "ON", then the contact slide pieces will not be coupled.

SUMMARY OF THE INVENTION

It is the object of this invention to develop an arrangement for coupling an auxiliary switch mechanism wherein, using simple means, a simple and reliable coupling to a contactor is facilitated.

Briefly stated in accordance with one aspect of the invention, the foregoing object is achieved by providing an arrangement for coupling an auxiliary switch mechanism to an electrical switchgear unit, having an auxiliary contact slide piece onto which moving auxiliary contact pieces are mounted and a switchgear contact slide piece onto which moving switchgear contact pieces are mounted. The arrangement has an auxiliary housing holding an auxiliary, fixed-mounted contact piece and a switchgear housing holding a switchgear, fixed-mounted contact piece which has a cutout therein. The arrangement is further characterized by having the contact slide pieces in the switchgear unit and the auxiliary switch mechanism mounted in such a manner that they can slide transversely to the direction of connection, wherein both housings and slide pieces form a positive connection when plugged in by means of a projection which can be inserted in the cutout, and wherein a lock establishes an effective connection with the auxiliary contact slide piece of the auxiliary switch mechanism, depending upon its position.

The reliability of the coupling is further improved if the projections or cutouts have spacing ribs.

A simple design of the effective connection is attained if the latter is handled by a strip-shaped lever fitted with a cutout, into which one end of the contact slide piece penetrates when the switchgear unit is on. The strip-shaped lever can be mounted on the front side of the auxiliary switch mechanism and can also be used to release the locking mechanism.

A further embodiment of the lever provides for the effective connection to occur by means of a strip-shaped lever with an extension, which in the event that the auxiliary switch mechanism has not been properly coupled, penetrates into the space in which the contact slide piece moves.

If the auxiliary switch mechanism has two tower-shaped catches which can be inserted in a cutout in the switchgear unit, which can be enclosed by a cover, then the locking can take place between the two towers so that they are protected against external influences and, on the other hand, also provide a safe seating for the auxiliary switch mechanism. The auxiliary switch mechanism in accordance with this invention need not do without the usual arrangement of voltage damping of the contactor if a cutout is designed in the auxiliary switch mechanism to lock in place and permit an electrical plug connection of a voltage damping device which corresponds to the cutout and the plug connection in the switchgear unit. The cutout can, if no voltage damping device is employed, be covered by an identification plate. When the voltage damping design is used, an alternative mounting arrangement for the identification plate will be provided.

In order to be able to adhere to the standard terminal designations even in an arrangement with an auxiliary switch mechanism, it is advatageous if the auxiliary switch mechanism and the switchgear unit are equipped with a plug-in coding. In order to design the seat for the auxiliary switch mechnism so as to prevent any free play in its plug-in direction, in a further aspect of the invention it is advantageous if the lock is designed with a inclining surface which functions as a brace when the two housings lock. For that purpose it has proven advantageous if the lock is designed as an eccentric member.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
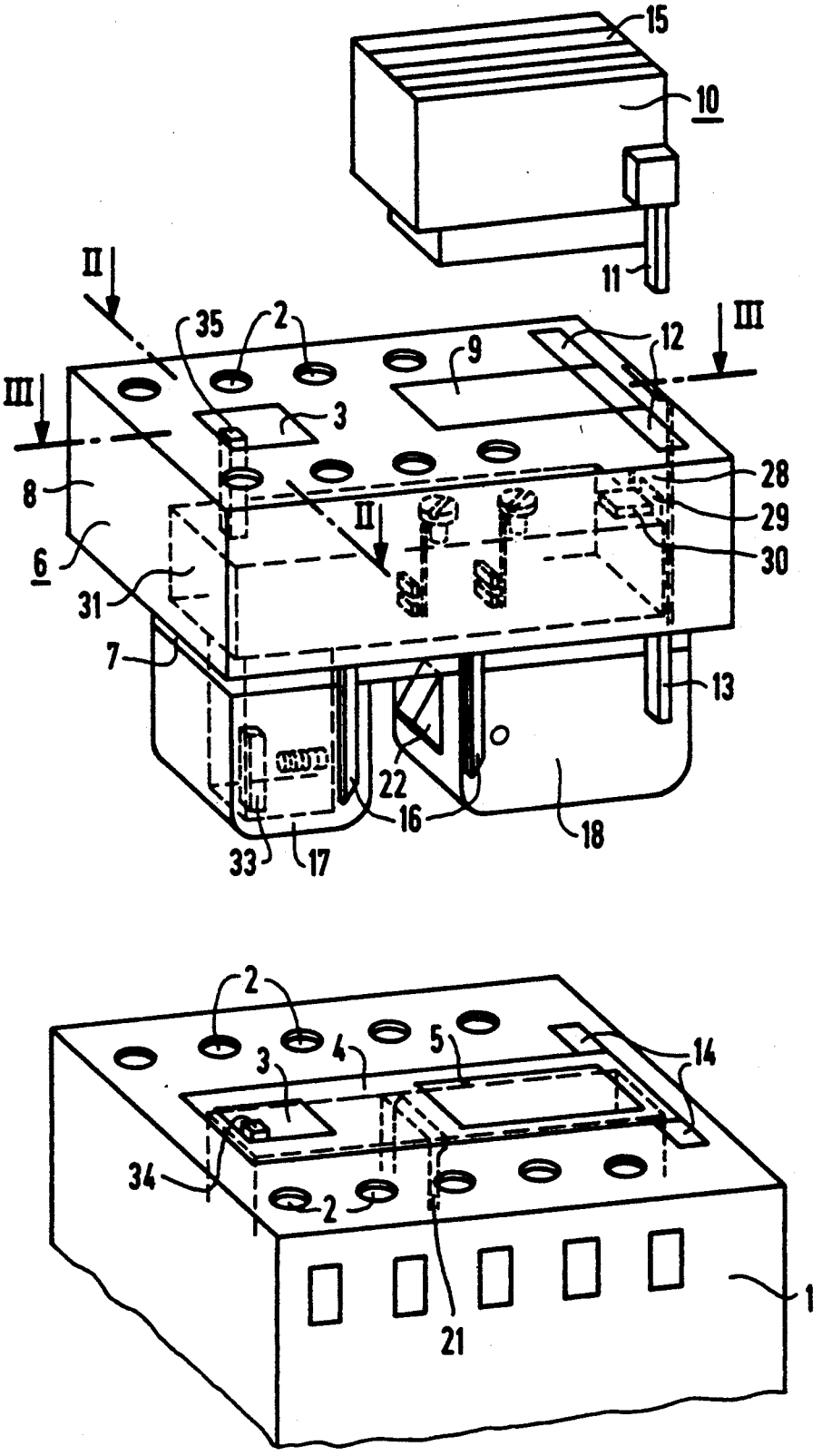
FIG. 1 shows an exploded view in perspective of the contactor, auxiliary contact mechanism and voltage damping element.

The contactor 1 shown schematically in FIG. 1 is connected on opposite sides to connections 2 and interspatially to a cutout 3 which is covered by a cover 4 in FIG. 1. In cover 4 there is a further cutout covered by a further cover 5. The auxiliary switch mechanism 6 is equipped with a projection 7 which after removing cover 4 can be slid into cutout 3. The upper section 8 of the auxiliary switch mechanism fitted with connectors 2 is designed cubically and narrower than contactor 1 so that connectors 2 of contactor 1 remain accessible after the auxiliary switch mechanism has been mounted. There is a cutout 9 in auxiliary switch mechanism 6 which can be covered by cover 5. After removing the cover, an RC circuit with a varistor or a diode, 10, can be snapped into cutout 9 for purposes of voltage damping. The electrical connection takes place upon insertion of contact blades 11 into the mating contacts 12. The mating contacts 12 end in contact blades 13 which can be inserted in mating contacts 14 at contactor 1 when installing the auxiliary switch mechanism. In the contactor itself the mating contacts 14 are connected to the coil connections of the contactor. Cover 5 can be fastened as an identification plate to RC circuit 10 by means of a mounting frame 15. If cover 4 remains on contactor 1 and cover 5 is removed, then RC circuit 10 can make contact directly with the contactor via mating contacts 14. Fitting strips 16 at projection 7 serve for coding the auxiliary switch mechanism 6.

Figure 2:
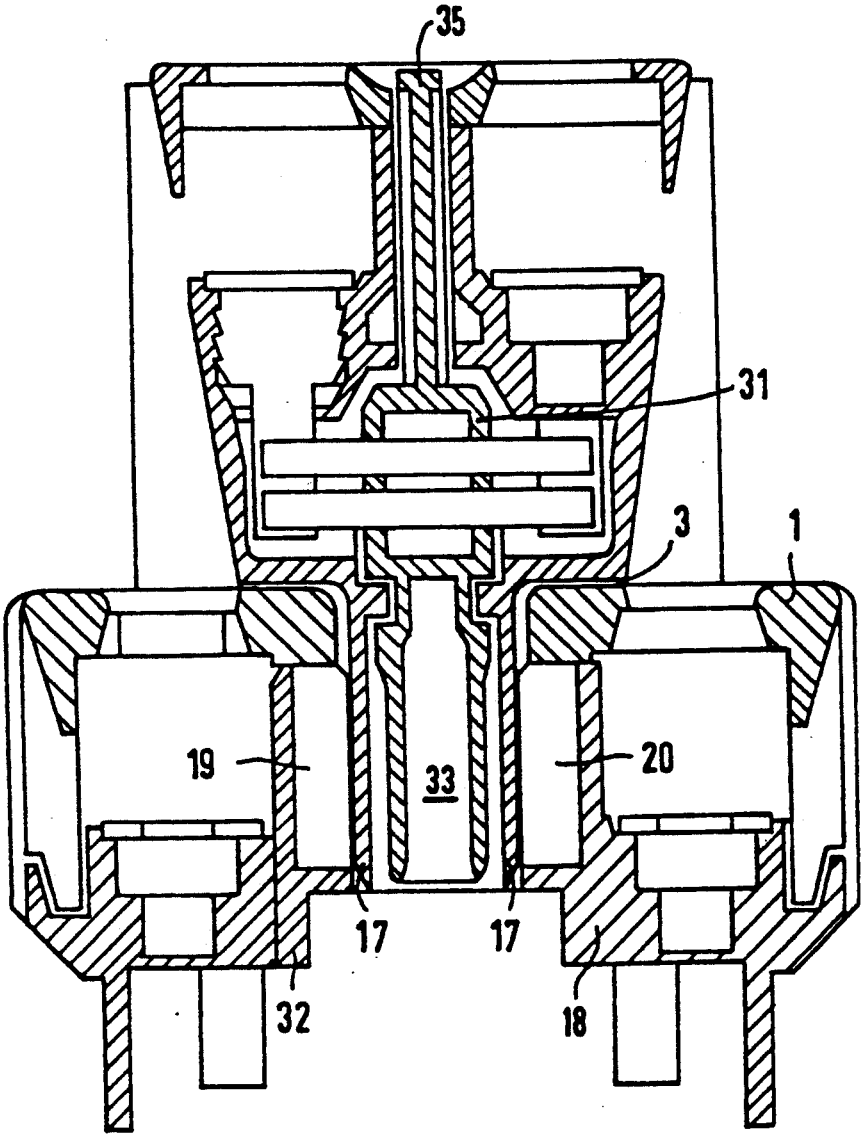
FIGS. 2 and 3 show front and side cross-sectional views along the lines II—II and III—III, respectively, and looking in the direction of the arrows in FIG. 1 of the auxiliary switch mechanism mounted on the contactor.
Figure 3:
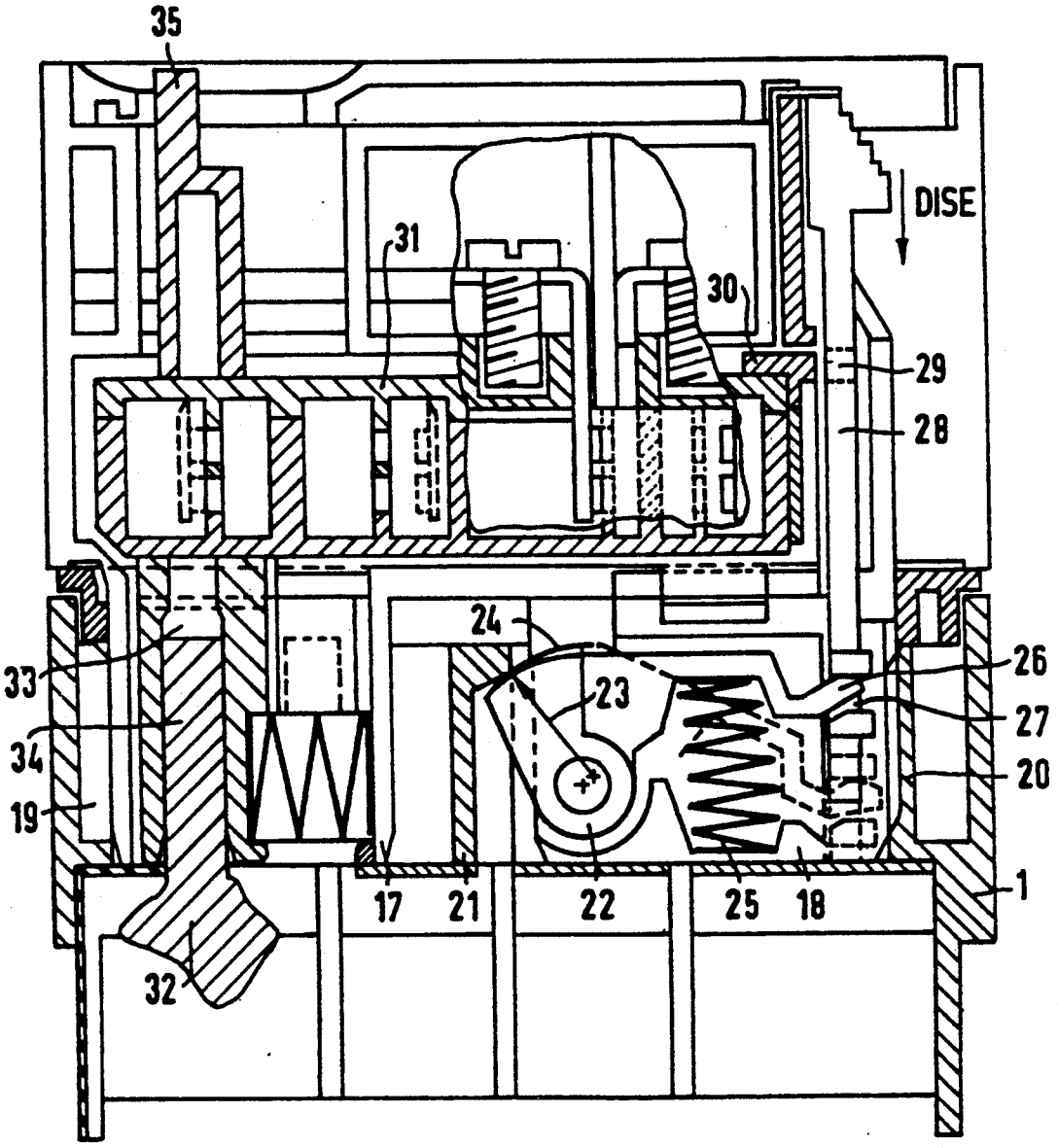

As FIGS. 2 and 3 show, projection 7 consists of two towers 17 and 18 which serve to limit cutout 3 at housing ribs 19, 20. Housing ribs 19, 20 can be designed as notch grids so that a tight seating of projection 7 or towers 17, 18 in cutout 3 is assured. A locking projection 21 of contactor 1 projects between both towers 17 and 18 and, when the auxiliary switch mechanism 6 is installed, mates with a swivel-mounted lock 22. Radius 23 is positioned asymmetrically in the mid-point of the rotating axis so that clamping surface 24 functions as an eccentric. The lock 22 is spring-loaded via spring 25 in its locking direction so that when installed, the auxiliary switch mechanism 6 automatically locks in place and is tensioned. An arm 26 of lock 22 penetrates into a slot 27 of a lever 28 which is movably mounted on the auxiliary switch mechanism 6. Said lever 28 is accessible from the front side of the auxiliary switch mechanism so that by pressure on lever 26 counter to the force of spring 25, the locking arrangement can be released. Lever 28 is further equipped with a cutout 29 into which a projection 30 of contact slide piece 31 of auxiliary switch mechanism 6 penetrates when the switchgear unit is on so that it is not possible to release the locking connection when the unit is switched on. It is also impossible to switch on the unit given improper seating of the auxiliary switch mechanism 6 because projection 30 cannot then be inserted into cutout 29. Lever 28 then clearly shows whether the mounting has been properly executed. It is similarly impossible to remove the auxiliary switch mechanism 6 while the unit is switched on.

Figures 9, 10:
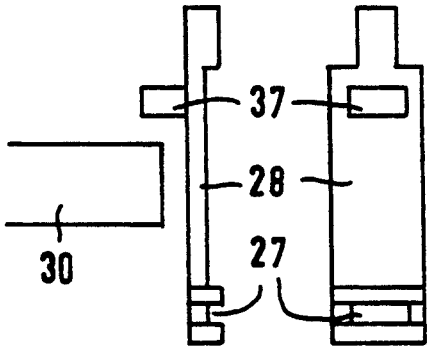
FIGS. 9 and 10 show front and side views of a further embodiment of the interlock lever.

The embodiment shown in FIGS. 9 and 10 of the interlock lever 28 has instead of cutout 29 a projection 37 which prevents the switch-on motion by projection 30 of contact slide piece 31. It is similarly impossible to release the mount connection with the unit switched on, as any shift of lever 28 for purposes of said release is impossible due to projection 30 of contact slide piece 31 being positioned such that it blocks the path of projection 37. The coupling between contact slide piece 31 of the auxiliary switch mechanism and contact slide piece 32 is handled by projection 34 of contact slide piece 32. which is inserted in cutout 33 of contact slide piece 31. Here, too, a tight-fitting coupling can be assured by spacing ribs. That is, the interior surface of cutout 33 may be provided with radially inwardly projecting spacing ribs (not shown), similar in form and function to spacing ribs 19 and 20, for gripping projection 34 of contact slide piece 32 more effectively. Alternatively, projection 34 may be provided with outwardly radially disposed spacing ribs (not shown) for more effectively gripping the interior of cutout 33. The purpose of the spacing ribs in this instance is to provide a tight fitting of coaxial parts perpendicular to the direction of insertion while simultaneously preventing an excessive degree of frictional resistance to removal. Such resistance might be encountered between a smooth bore and a smooth inserted member having a tight coaxial fit. The spacing ribs reduce the area of contact between the inserted member and the receptive member and thus the total frictional resistance parallel to the direction of insertion and removal.

An extension 35 of contact slide piece 31 serves to indicate the switching position. Projection 34 of contact slide piece 32 serves as the position indicator when the auxiliary switch mechanism 6 has been removed. Contact slide piece 31 is continually held in its out position by return pressure spring 38 so that any insertion of the auxiliary switch mechanism 6 is impossible while breaker 1 is switched on, because projection 31 of contact slide 32 does not fit into cutout 33.

Referring to FIG. 3, the cross-hatching shows that locking projection 21 is part of contactor 1. Rotatable lock 22 is swivel or rotatably mounted in the housing of auxiliary switch mechanism 6. Spring 25 urges swivel mounted lock 22 to rotate in a counter clockwise direction and since swivel mounted lock 22 is eccentrically mounted, it engages locking projection 21. Projection 30 of contact slide piece 31 and lever 28 are shown in FIG. 3. When contact slide piece 31 is moved to the right, projection 30 can be slid into opening 29 of slide piece 31, so that the release of auxiliary switch mechanism 6 of contactor 1 is prevented. Only ribs 19 and 20 which functionally cooperate with towers 17 and 18 are shown in FIG. 3.

In order to promote the interchangibility and compatibility of parts manufactured by different manufacturers in the electronics industry, and to facilitate ease of description and use, certain standards have evolved and/or have been promulgated by agreement by the electronics industry, educational institutions and professional organizations. With respect to the present invention, certain applications for contactors and associated auxilliary switch mechanisms, have, through the process mentioned above, been assigned standard terminal configurations and designations. That is, circuit continuity relationships between the terminals, and terminal designations on contactors or auxilliary switch mechanisms for particular applications are predefined by industry-wide standards. Configurational and designational standards are typically assigned an identifying nomenclature for easy reference. Such standardization has been found useful both in the United States and abroad. For example, the European industrial community has generated standards for motor contactor terminal designations and circuit continuity configurations and assigned nomenclature to these standard configurations, e.g., DIN EN 50012 is the nomenclature for a standard motor contactor configuration. Auxilliary switch mechanism terminals have been similarly standardized. DIN EN 50011 is nomenclature for a standard European auxilliary switch configuration. In order to ensure that the terminal designations can be carried out in accordance with the corresponding standards, for example, auxiliary contactors in accordance with DIN EN 50011 and motor contactors in accordance with DIN EN 50012, it must be assured that only suitable auxiliary switch mechanisms can be mounted on specially designed contactors.

Figures 4, 5, 6:
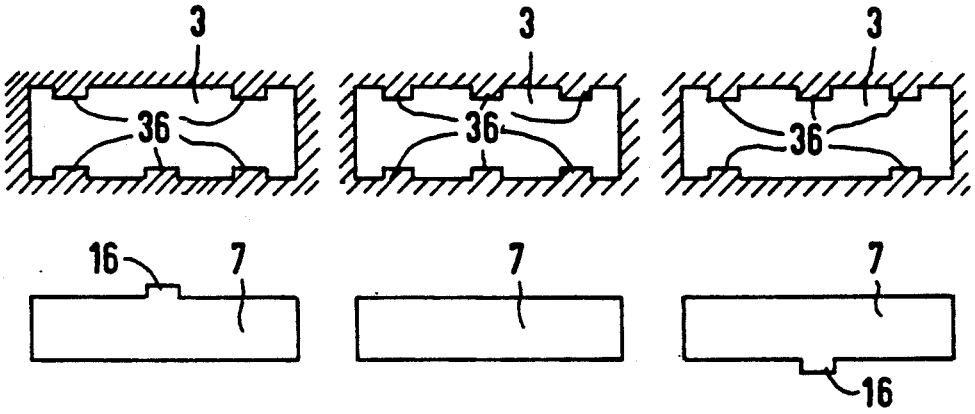
FIGS. 4, 5 and 6 illustrate cross-sectional views of the contactor and attachment with varying codings.
Figures 7, 8:
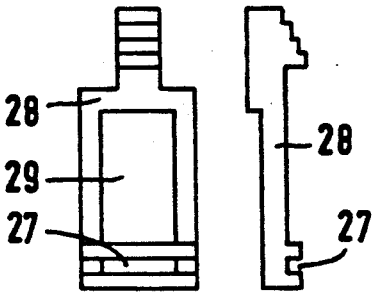
FIGS. 7 and 8 show front and side views of the interlock lever.

In the embodiment in accordance with FIG. 4, the coding strip 16 on projection 7 on auxiliary switch mechanism 6 is arranged so that the auxiliary switch mechanism 6 can only be inserted in cutout 3 in accordance with FIG. 4. For that purpose projections 36 are designed in cutout 3. The auxiliary switch mechanism in accordance with FIG. 4 cannot be inserted in cutouts 3 in accordance with FIGS. 5 and 6 since in the location where projection 16 is positioned, projections 36 penetrate into cutout 3. If the projections 7 take the form of those in FIG. 5, a use in contactors having a coding in accordance with FIG. 4 and 6 is possible, also. The coding of projection 7 in accordance with FIG. 6 can only be inserted in cutout 3 in accordance with FIG. 6. The type of mounting in accordance with FIG. 4 is, for example, usable as a mounting attachment for an auxiliary contactor so that the terminal designation in accordance with European Standard DIN EN 50011 is adhered to. The embodiment in accordance with FIG. 6 is, for example, designed for a motor contactor so that the terminal designation in accordance with European Standard DIN EN 50012 is complied with. In the embodiment in accordance with FIG. 5 the standards have not been taken into account since mounting attachment 4 can be used in any fashion.

It will now be understood that there has been disclosed an improved arrangement for coupling an auxiliary switch to a switchgear unit. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured as Letters Patent of the United States is:

1. An arrangement including a contactor, further including an auxiliary switch mechanism and means for coupling said auxiliary switch mechanism to said contactor, said auxiliary switch mechanism having an auxiliary contact slide piece onto which moving auxiliary contact pieces are mounted and a switchgear contact slide piece onto which switchgear moving contact pieces are mounted, and said arrangement including an auxiliary housing holding an auxiliary, fixed-mounted contact piece and a switchgear housing holding a switchgear fixed-mounted contact piece having a cutout therein, further characterized by having the contact slide pieces in said contactor and in said auxiliary switch mechanism slidably mounted for sliding transversely to the direction of connection, wherein said housings and slide pieces form a positive connection when plugged in by means of an extension which can be inserted in the cutout, and wherein a lock connected to the switchgear unit is coupled to the auxiliary contact slide piece of said auxiliary switch mechanism for preventing movement of said contact slide pieces into a working position when coupling between said slide pieces and said housings is incomplete and for preventing coupling when said contact slide pieces of said contactor are already in a working position.

2. An arrangement according to claim 1, further characterized in that one of said housings and slide pieces comprises spacing ribs.

3. An arrangement according to claim 1, further characterized by having a second cutout feature spacing ribs.

4. An arrangement in accordance with claim 1, further characterized by having the effective connection handled by a strip-shaped lever with a cutout therein, into which one end of the auxiliarly contact slide piece penetrates when the switchgear unit is switched "ON".

5. An arrangement in accordance with claim 2, further characterized by having the effective connection handled by a strip-shaped lever with a cutout therein, into which one end of the auxiliarly contact slide piece penetrates when the switchgear unit is switched "ON".

6. An arrangement in accordance with claim 3, further characterized by having the effective connection handled by a strip-shaped lever with a cutout therein, into which one end of the auxiliarly contact slide piece penetrates when the switchgear unit is switched "ON".

7. An arrangement according to claim 1, wherein means for providing said functional cooperation comprises a strip-shaped lever with a projection thereon which, when the auxiliary switch mechanism is not properly coupled, penetrates into the area through which the auxiliary contact slide pieced moves.

8. An arrangement according to claim 2, wherein means for providing said functional cooperation comprises a strip-shaped lever with a projection thereon which, when the auxiliary switch mechanism is not properly coupled, penetrates into the area through which the auxiliary contact slide piece moves.

9. An arrangement according to claim 3, wherein means for providing said functional cooperation comprises a strip-shaped lever with a projection thereon which, when the auxiliary switch mechanism is not properly coupled, penetrates into the area through which the auxiliary contact slide piece moves.

10. An arrangement in accordance with claim 1, further characterized by having the auxiliary switch mechanism have two tower-shaped attachments which can be inserted into the cutout of the switchgear unit which can be covered by a cover.

11. An arrangement in accordance with claim 2, further characterized by having the auxiliary switch mechanism have two tower-shaped attachments which can be inserted into the cutout of the switchgear unit which can be covered by a cover.

12. An arrangement in accordance with claim 3, further characterized by having the auxiliary switch mechanism have two tower-shaped attachments which can be inserted into the cutout of the switchgear unit which can be covered by a cover.

13. An arrangement in accordance with claim 4, further characterized by having the auxiliary switch mechanism have two tower-shaped attachments which can be inserted into the cutout of the switchgear unit which can be covered by a cover.

14. An arrangement in accordance with claim 5, further characterized by having the auxiliary switch mechanism have two tower-shaped attachments which can be inserted into the cutout of the switchgear unit which can be covered by a cover.

15. An arrangement in accordance with claim 6, further characterized by having the auxiliary switch mechanism have two tower-shaped attachments which can be inserted into the cutout of the switchgear unit which can be covered by a cover.

16. An arrangement in accordance with claim 7, further characterized by having the auxiliary switch mechanism have two tower-shaped attachments which can be inserted into the cutout of the switchgear unit which can be covered by a cover.

17. An arrangement in accordance with claim 8, further characterized by having the auxiliary switch mechanism have two tower-shaped attachments which can be inserted into the cutout of the switchgear unit which can be covered by a cover.

18. An arrangement in accordance with claim 9, further characterized by having the auxiliary switch mechanism have two tower-shaped attachments which can be inserted into the cutout of the switchgear unit which can be covered by a cover.

19. An arrangement according to claim 1, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

20. An arrangement according to claim 2, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

21. An arrangement according to claim 3, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

22. An arrangement according to claim 4, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

23. An arrangement according to claim 5, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

24. An arrangement according to claim 6, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

25. An arrangement according to claim 7, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

26. An arrangement according to claim 8, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

27. An arrangement according to claim 9, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

28. An arrangement according to claim 10, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

29. An arrangement according to claim 11, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

30. An arrangement according to claim 12, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

31. An arrangement according to claim 13, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

32. An arrangement according to claim 14, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

33. An arrangement according to claim 14, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

34. An arrangement according to claim 15, wherein the auxiliary switch mechanism has a cutout therein corresponding to the switchgear cutout and and an electrical plug connection of a voltage damping element corresponding to a plug connection in the switchgear unit permitting the auxiliary switch mechanism to lock in place.

35. An arrangement according to claim 16, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

36. An arrangement according to claim 17, wherein the auxiliary switch mechanism has a cutout therein corresponding to the switchgear cutout and an electrical plug connection of a voltage damping element corresponding to a plug connection in the switchgear unit permitting the auxiliary switch mechanism to lock in place.

37. An arrangement in accordance with claim 19, further characterized by having the auxiliary switch cutout designed in such a manner that it can be covered by an identification plate.

38. An arrangement according to claim 1, further characterized by having the auxiliary switch mechanism and switchgear unit fitted with a plug-in coding arrangement.

39. An arrangement according to claim 1, further characterized by having the lock designed with an inclined surface which during locking braces both housings together.

40. An arrangement in accordance with claim 39, further characterized by having the lock designed as an eccentric member.

41. A contactor with an auxiliary switch mechanism having an arrangement for coupling the auxiliary switch mechanism to the contactor, the auxiliary switch mechanism having an auxiliary contact slide piece onto which moving auxiliary contact pieces are mounted and said arrangement including an auxiliary housing holding an auxiliary, fixed-mounted contact piece and the contactor having a contact slide piece onto which moving contact pieces are mounted and the contactor having a housing holding a fixed-mounted contact piece, and the contact slide pieces in the contactor and the auxiliary switch mechanism are slidably mounted for sliding transversely to the direction of connection, wherein both housings and slide pieces form a positive connection, when plugged in by means of an extension which can be inserted in a cutout, and a lock is provided that prevents movement of the contact slide pieces into the working position if the coupling between slide pieces and housings is not perfect or the coupling of the contact slide pieces of the contactor are already in working position.

* * * * *